US006152705A

United States Patent [19]

Kennedy et al.

[11] Patent Number: 6,152,705

[45] Date of Patent: Nov. 28, 2000

[54] AIR DRIVE PUMPS AND COMPONENTS THEREFOR

[75] Inventors: Dennis E. Kennedy, Fontana; Dennis D. Eberwein; Robert F. Jack, both of Riverside, all of Calif.

[73] Assignee: Wilden Pump & Engineering Co., Colton, Calif.

[21] Appl. No.: 09/116,029

[22] Filed: Jul. 15, 1998

[51] Int. Cl.[7] ..... F04B 43/06

[52] U.S. Cl. ..... 417/395; 417/394; 137/102; 91/280; 91/264; 91/268; 91/271

[58] Field of Search ..... 417/395, 394; 137/102; 91/264, 265, 268, 271, 280

[56] References Cited

U.S. PATENT DOCUMENTS

| | | | |
|---|---|---|---|
| D. 275,858 | 10/1984 | Wilden . | |
| D. 294,946 | 3/1988 | Wilden . | |
| D. 294,947 | 3/1988 | Wilden . | |
| 2,610,859 | 9/1952 | Wilcox et al. | 137/102 |
| 3,519,011 | 7/1970 | Pennanen | 137/102 |
| 3,838,946 | 10/1974 | Schall | 417/395 |
| 3,967,635 | 7/1976 | Sealfon et al. | 137/102 |
| 4,041,970 | 8/1977 | Peters | 137/102 |
| 4,242,941 | 1/1981 | Wilden et al. . | |
| 4,247,264 | 1/1981 | Wilden . | |
| 4,524,803 | 6/1985 | Stoll et al. . | |
| 4,549,467 | 10/1985 | Wilden et al. . | |
| 5,169,296 | 12/1992 | Wilden . | |
| 5,213,485 | 5/1993 | Wilden . | |
| 5,584,666 | 12/1996 | Kozumplik, Jr. et al. | 137/102 |
| 5,607,290 | 3/1997 | Duncan . | |
| 5,694,965 | 12/1997 | Roulet | 137/102 |
| 5,927,954 | 7/1999 | Kennedy et al. | 417/395 |
| 5,957,670 | 9/1999 | Duncan et al. . | |

FOREIGN PATENT DOCUMENTS

1687300 A1 10/1991 U.S.S.R. .

*Primary Examiner*—Charles G. Freay
*Assistant Examiner*—Cheryl J. Tyler
*Attorney, Agent, or Firm*—Lyon & Lyon LLP

[57] ABSTRACT

An air driven double diaphragm pump has two opposed pumping cavities with diaphragms extending thereacross. A shaft extends between the diaphragms and through an actuator housing. The housing includes a control valve assembly having a control valve to direct pressurized air to one or the other of the dual pumping cavities and two relief valves which cooperate with the pump shaft position to release air from one end or the other of the control valve for the shifting thereof. Shuttle valve elements are positioned between the control valve and the pumping chambers. The shuttle valve elements are slidably positioned within the valve cavities to move between extreme positions under the pressures within the input and the pumping cavity. In one extreme position, the pumping cavity is in communication with an exhaust having a tapered passage. In the other, the exhaust is cut off and pressurized air is able to pass through a one-way valve in a passageway through the shuttle valve element to charge the pumping chamber.

22 Claims, 4 Drawing Sheets

AIR DRIVE PUMPS AND COMPONENTS THEREFOR

BACKGROUND OF THE INVENTION

The field of the present invention is air driven reciprocating devices.

Pumps having double diaphragms driven by compressed air directed through an actuator valve are well known. Reference is made to U.S. Pat. Nos. 5,213,485; 5,169,296; and 4,247,264; and to U.S. Pat. Nos. Des. 294,946; 294,947; and 275,858. Actuator valves using a feedback control system are disclosed in U.S. Pat. Nos. 4,242,941 and 4,549,467. The disclosures of the foregoing patents are incorporated herein by reference.

Common to the aforementioned patents on air driven diaphragm pumps is the disclosure of two opposed pumping cavities. The pumping cavities each include a pump chamber housing, an air chamber housing and a diaphragm extending fully across the pumping cavity defined by these two housings. Each pump chamber housing includes an inlet check valve and an outlet check valve. A common shaft typically extends into each air chamber housing to attach to the diaphragms therein.

An actuator valve receives a supply of pressurized air and operates through a feedback control system to alternately pressurize and vent the air chamber side of each pumping cavity through a control valve piston. Feedback to the control valve piston has been provided by the position of the shaft attached to the diaphragms which includes one or more passages to alternately vent the ends of the valve cylinder within which the control valve piston reciprocates. By selectively venting one end or the other of the cylinder, the energy stored in the form of compressed air at the unvented end of the cylinder acts to drive the piston to the alternate end of its stroke. The pressure builds up at both ends of the control valve piston between strokes. Pressurized air is allowed to pass longitudinally along the piston within the cylinder to the ends of the piston. Consequently, a clearance has typically been provided between the control valve piston and the cylinder.

Under proper conditions, the shifting energy is more than sufficient to insure a complete piston stroke. However, under adverse conditions, the damping or resistance to movement of the piston may so increase relative to the pressure available that the system may require all available potential energy for shifting of the piston. Under such marginal conditions, all possible energy is advantageously applied to insure operation of the actuator valve. One mechanism for providing additional energy for shifting is presently included in the devices of the aforementioned patents. Additional compressed air is supplied through passageways to the expanding chamber at one end of the control valve piston. The air is gated into the passageways by the location of the piston. Control of that energy in the control valve assembly itself is also important. Reference is made to U.S. patent application Ser. No. 09/063,253, the disclosure of which is incorporated herein by reference.

Air driven systems, using the expansion of compressed gasses to convert potential energy into work, can experience problems of icing when there is moisture in the compressed gas. As the gas expands, it cools and is unable to retain as much moisture. The moisture condensing from the cooled gas can collect in the passageways and ultimately form ice. This can result in less efficient operation and stalling. One solution is to be found in U.S. Pat. No. 5,607,290, the disclosure of which is incorporated herein by reference.

The control of expansion of the compressed gasses can be aided by a diffuser outlet from the valve for self purging. The diffuser allows a distribution of expanding gases from a constrained area with a diverging surface making ice formation difficult. One such system is disclosed in U.S. Pat. No. 5,957,670, the disclosure of which is incorporated herein by reference.

Relief valves controlling control valve assemblies are disclosed in U.S. patent application Ser. No. 08/842,377, the disclosure of which is incorporated herein by reference. The valve, independently configured, provides positive opening characteristics through the accumulation of energy before actuation.

SUMMARY OF THE INVENTION

The present invention is directed to a valving system and its configuration which provides one-way flow into a chamber and a fairly direct controlled vent path from the chamber. Actual operating parameters of the fluid state within the pump is able to control the valve.

Accordingly, it is a first separate aspect of the present inventions to provide a shuttle valve controlled by pressure within the system. The shuttle valve includes one-way flow in a first direction directly through the valve body. One-way flow in the opposite direction is routed laterally from the valve.

In a second separate aspect of the present invention, the 4. valve of the first aspect includes an exhaust port having a tapered path to atmosphere. The increase in cross-sectional area of the exhaust port may be about three times the original port area.

In a third separate aspect of the present invention, the valve of the first aspect is incorporated into an air driven diaphragm pump. Released fluid is able to pass from the pump without going through the control valve assembly which would otherwise cool the valve.

In a fourth separate aspect of the present invention, a relief valve having the aspects of accumulating potential energy prior to actuation is incorporated into the housing structure of the pump actuator. A cavity within the actuator receives a relief valve body which has a guideway, a relief valve seat and an exhaust. A flow path from the control valve extends from the cavity within the actuator across the relief valve seat to the exhaust.

In a fifth separate aspect of the present invention, a double diaphragm pump includes a source of pressurized fluid having two charging passages which alternately receive pressurized fluid. The double diaphragm pump further includes two opposed pumping cavities with diaphragms therein to define air chamber cavities. A valving system controls communication between the charging passages, the air chamber cavities and atmosphere. Two valves each include three ports. The first port is in communication with the charging passages; the second port is in communication with the air chamber cavities; and the third ports extend to atmosphere. One-way valves are found between the charging passages and the air chamber cavities to prevent flow toward the charging passages and restrict flow toward the air chamber cavities below a preselected pressure.

In a sixth separate aspect of the present invention, combinations of the foregoing separate aspects are contemplated.

Accordingly, it is an object of the present invention to provide improved mechanisms and systems for air driven diaphragm pumps. Other and further objects and advantages will appear hereinafter.

DETAILED DESCRIPTION OF THE PREFERRED EMBODIMENT

Figure 1:
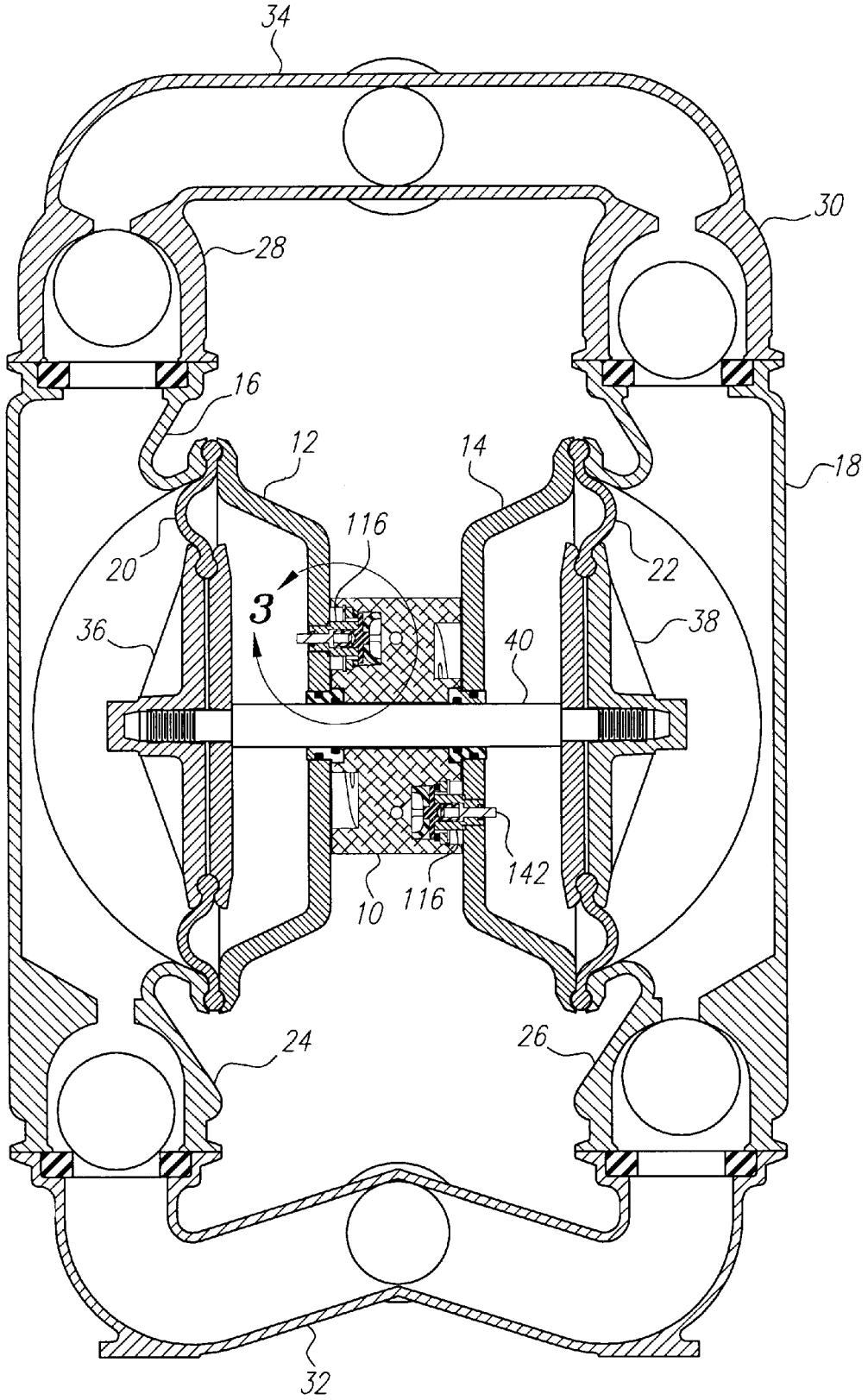
FIG. 1 is a cross-sectional side view of an air driven diaphragm pump.

Turning in detail to the drawings, an air driven diaphragm pump is illustrated in FIG. 1. The pump includes a center section 10 which provides the actuator system for the pump. Two opposed air chambers 12 and 14 are fixed to the center section 10 and face outwardly to define cavities to receive driving air from the actuator. Pump chambers 16 and 18 are arranged to mate with the air chambers 12 and 14, respectively, to define pumping cavities divided by diaphragms 20 and 22. The pump chambers 16 and 18 include inlet ball valves 24 and 26 and outlet ball valves 28 and 30 associated with respective inlets and outlets. An inlet manifold 32 supplies material to be pumped to the ball valves 24 and 26. An outlet manifold 34 discharges from the outlet ball valves 28 and 30.

About their periphery, the diaphragms 20 and 22 include beads which are held between the air chambers 12 and 14 and the pump chambers 16 and 18. About the inner periphery, the diaphragms 20 and 22 are held by pistons 36 and 38. The pistons are coupled with a shaft 40 which extends across the center section 10 and is slidable therein such that the pump is constrained to oscillate linearly as controlled by the shaft 40.

The center section or center block 10 includes the actuation mechanism for reciprocating the pump. In addition to providing a physical attachment and positioning of the pump assembly through the attachment to the air chambers 12 and 14, the center section 10 provides bearing support for the shaft 40. A passageway 42 extends through the center section 10 to receive the shaft 40. The passageway includes two bushings 44 and 46 which are seated in both the center section 10 and in the body of the air chambers 12 and 14. Exterior O-rings 48 and interior seals 50 prevent leakage of air pressure from the alternately pressurized chambers.

Figure 2:
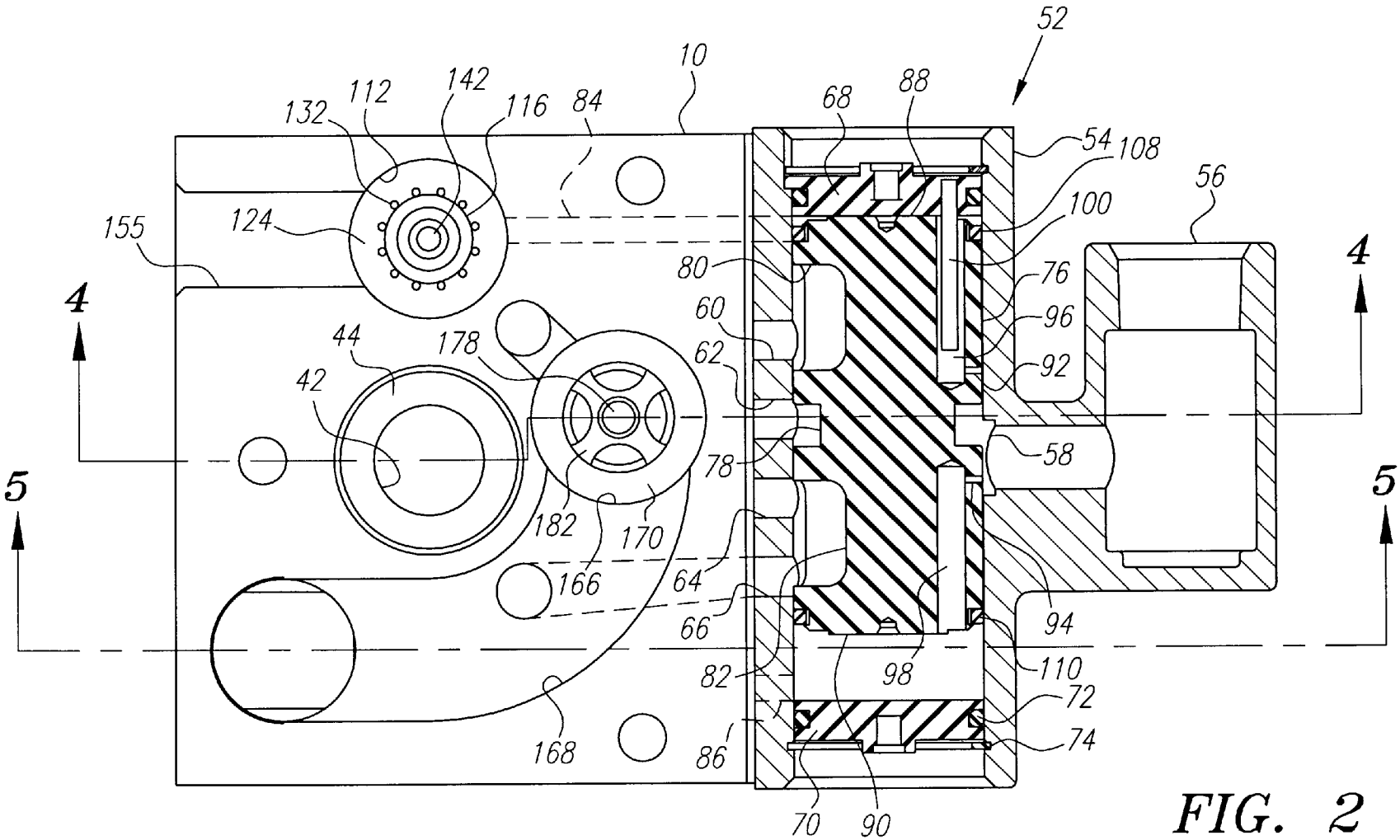
FIG. 2 is a side view of an actuator for the pump of FIG. 1 with a valve cylinder illustrated in cross section.

Turning to the actuator, a control valve assembly, generally designated 52, is illustrated in FIG. 2. The valve assembly 52 includes a cylinder 54. The cylinder 54 includes an inlet passage 56 with means for coupling with a source of pressurized air. An inlet port 58 extends from the inlet passage 56 into the cylinder 54. A series of passageways 60 through 66 extend from the cylinder 54 through the wall thereof in a position diametrically opposed to the inlet port 58. The passageways 60 and 66 are vent passageways which lead to exhaust while the passageways 62 and 64 are charging passageways which lead to air chambers 12 and 14. The passageways 60 through 66 provide alternate pressurizing and venting to these air chambers 12 and 14 by alternately coupling the charging passageways 62 and 64 with the vent passageways 60 and 66 and the inlet passage 56.

The cylinder 54 is closed at the ends by end caps 68 and 70. The end caps 68 and 70 each include an annular groove for receipt of a sealing O-ring 72. Circular spring clips 74, each held within an inner groove within the wall of the cylinder 54, retain the end caps 68 and 70 in place.

A control valve piston 76 is located within the cylinder 54 and allowed to reciprocate back and forth within the cylinder. The control valve piston 76 has an annular groove 78 which is centrally positioned about the control valve piston 76. This annular groove 78 cooperates with the inlet port 58 to convey pressurized air supplied through the inlet passage 56 around the control valve piston 76 to one or the other of the passageways 62 and 64 for delivery to the air driven reciprocating device. Cavities 80 and 82 are cut into the bottom of the control valve piston 76. These cavities 80 and 82 are positioned over the passageways 60 through 66 so as to provide controlled communication between the passageway 60 and the passageway 62 and also between the passageway 64 and the passageway 66. As can be seen in FIG. 2, the cavity is providing communication between the passageways 64 and 66. This allows venting of one side of the reciprocating device. With the control valve piston 76 in the same position, the annular groove 78 is in communication with the passageway 62 to power the other side of the reciprocating device. The opposite configuration is provided with the control valve piston 76 at the other end of its stroke.

To control the control valve assembly 52, valve control passages 84 and 86 are positioned at either end of the cylinder 54. These passages 84 and 86 extend to cooperate with pressure relief valves as part of the control valve assembly 52. To shift the control valve piston 76, one or the other of the passages 84 and 86 is vented to atmosphere. In between shifts, pressure is allowed to accumulate within the entire cylinder 54. With one end vented, the accumulated pressure at the other end shifts the piston. To increase energy for shifting, bosses 88 and 90 are provided at the ends of the control valve piston 76. Thus, an area is provided for the accumulation of pressurized air even with the control valve piston 76 hard against the most adjacent end cap 68 or 70.

To increase the shifting capability of the control valve piston 76, radial holes 92 and 94 extend into the control piston 76. The radial holes communicate with axial passageways 96 and 98 which extend to the ends of the control valve piston 76. The radial holes 92 and 94 are spaced to be slightly wider than the inlet port 58. Thus, once the piston reaches a midpoint in its stroke, the hole most advantageously conveying additional pressure to the expanding end of the cylinder 54 is uncovered and contributes further to the shift. A pin 100 extends into one of the axial passageways 96 and 98 so as to orient the control valve piston 76 angularly within the cylinder 54.

To insure that enough energy for the control valve piston 76 to shift is accumulated prior to each successive shift, the positive clearance present between the periphery of the control valve piston 76 and the cylinder wall 54 is controlled. Excessive clearance allows the pressurized air accumulated behind the end of the piston to escape without transferring sufficient energy to the piston itself.

Because of the differential pressure across the cylinder 54 from the inlet port 58 to the passageways 60 through 66 and the repeated back-and-forth action of the control valve piston 76 in the cylinder 54, wear occurs on the lower side of the control valve piston 76. Consequently, positive clearance continues to accumulate with operation of the actuator. With enough wear, the control valve piston 76 must be replaced.

The control valve piston 76 includes circumferential grooves located adjacent the beveled ends of the control valve piston 76. Piston rings 108 and 110 are positioned within the circumferential grooves. The piston rings 108 and 110 are positioned by forcing the resilient rings over the beveled ends of the control valve piston 76 so as to enter the circumferential grooves. The piston rings float within the grooves in that their inner peripheral diameter is larger than the outer diameter at the bottom of the grooves. The piston rings 108 and 110 are also preferably a bit thinner than the grooves to enhance the floating characteristic. The cylinder 54, the control valve piston 76 and the piston rings 108 and 110 are preferably circular in cross section. The outer profile of each of the piston rings 108 and 110 is slightly larger than that of the control valve piston 76. Even so, the outer circumference of the piston rings 108 and 110 still exhibit a positive clearance with the wall of the cylinder 54. With net positive clearance, the control valve piston with the rings can move easily within the cylinder 54.

With the floating piston rings 108 and 110, it has been found that the control valve piston 76 may be of a self-lubricating polymeric material such as acetal polymer with PTFE filler. The rings 108 and 110 may be of the same material. The control valve piston 76 continues to wear at what would be an unacceptable rate. However, the piston rings 108 and 110 are not forced against the wall of the cylinder 54 and exhibit far less wear than the control valve piston 76. Consequently, the appropriate clearance between the piston rings 108 and 110 of the control valve piston 76 can be maintained with the cylinder 54.

The control valve assembly further includes pressure relief valves to control the valve control passages 84 and 86. Two relief valve cavities 112 are arranged in the housing constituting the center section 10. The relief valve cavities 112 are arranged to either side of the center section 10 so that they face the air chambers 12 and 14, respectively. A bore 114 extends through each of the air chambers 12 and 14 to accommodate a portion of the valve assemblies. The relief valves are identical and oriented in opposite directions.

Figure 3:
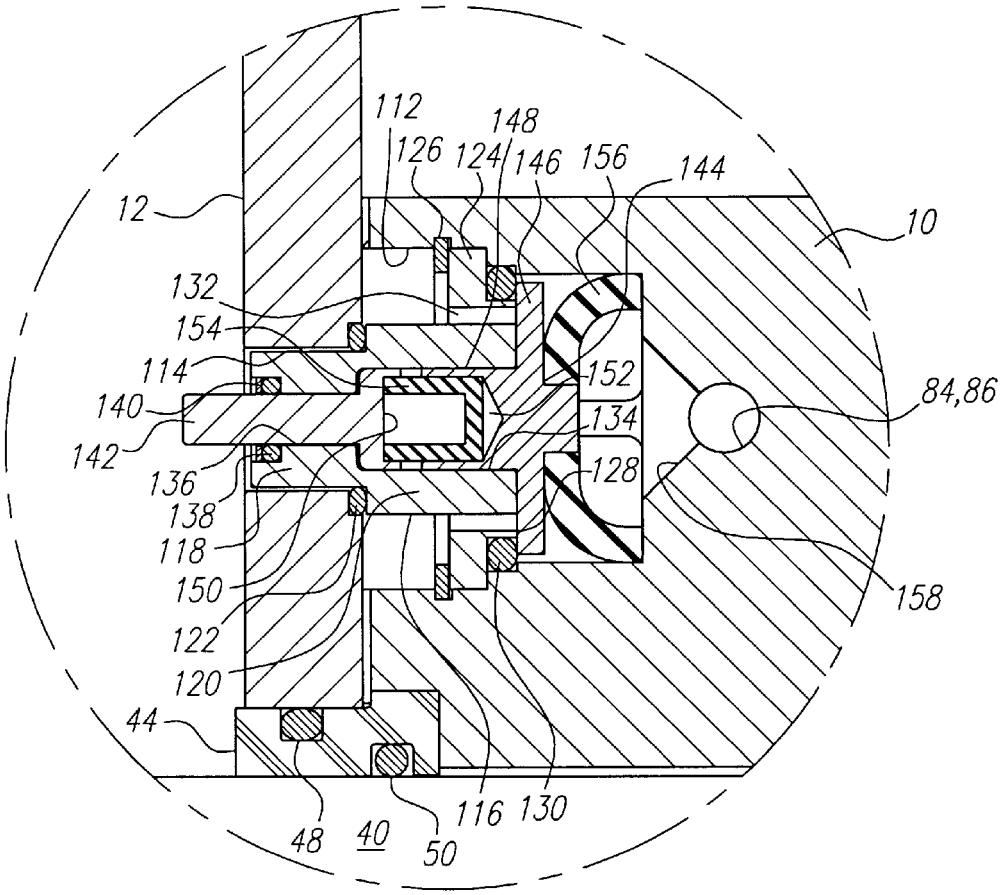
FIG. 3 is a cross-sectional detail taken as indicated in FIG. 1 illustrating the detail of a relief valve.

Positioned within each relief valve cavity 112 and bore 114 is a relief valve body 116. The relief valve body 116 is generally symmetrical about a centerline and includes a first cylindrical portion 118 that fits within the bore 114. A cylindrical portion 120 of the relief valve body 116 extends from the first cylindrical portion 118 with a shoulder to accommodate an O-ring 122 as can be seen in FIG. 3. Adjacent to the cylindrical portion 120 is a radial flange 124 extending outwardly from the cylindrical portion 120. The flange 124 seats within the relief valve cavity 112 and is held in place by a snap ring 126. A final cylindrical portion 128 adjacent to the flange 124 cooperates with the relief valve cavity 112 to provide a seat with a sealing O-ring 130. Exhaust passages 132 extend through the flange portion 124 and the cylindrical portion 128 about the relief valve 116 in an arrangement best seen in FIG. 2.

A first guideway portion 134 extends partway through the relief valve 116. A second portion 136 of the guideway of smaller diameter than the guideway portion 134 completes the passage through the relief valve 116. An O-ring 138 and a retaining washer 140 provide sealing along the smaller guideway portion 136. An actuator pin 142 is positioned in the smaller guideway portion 136 so as to extend from the end of the first cylindrical portion 118 into the air chamber 12, 14. From FIG. 1, it can be seen that the actuator pins 142 will interfere with the stroke of the pistons 36 and 38. The length of the actuator pins 142 is such that the pins provide preselected limits to the shaft stroke.

A relief valve element 144 is positioned within the relief valve cavity 112 and extends into the guideway 134. The relief valve element 144 includes a cylindrical plate 146 which extends over the cylindrical portion 128. Thus, the cylindrical portion 128 and the O-ring 130 operate as a relief valve seat. The relief valve element 144 includes an actuator 148 which extends into the guideway portion 134. The actuator pin 142 includes a socket 150 which is also in the guideway portion 134. The actuator 148 provides a socket 152 facing the socket 150. The two sockets 150 and 152 accommodate a compression spring 154. The compression spring is an elastomeric cylinder which is closed at one end and contains a cavity. In the relaxed state, the compression spring 154 holds the actuator 148 and the actuator pin 142 apart. Consequently, compression of these two elements positioned within the guideways 134 and 136 is possible until the socket portions 150 and 152 abut end to end. Potential energy can be developed in the compression spring 154.

The relationship of the plate 146 with the relief valve element 144 creates a flow path from the relief valve cavity 112 across the seat defined by the cylindrical portion 128 and O-ring 130 and through the exhaust passages 132. The air is then vented from the housing through a passage 155 to atmosphere.

A valve spring 156 of resilient material formed in a cross with a hole therethrough to receive the end of the relief valve element 144 is placed in compression within the relief valve cavity 112 against the relief valve element 144. The passageway 84, 86 extends to the relief valve cavity 112 at the other end thereof. A conical nozzle 158 is positioned at the end of the passageway 84, 86 to avoid icing concerns.

The cross-shaped valve spring 156 is arranged in a flattened dome shape. Because of the shape, a spring constant is relatively small through the anticipated movement of the valve element 144. This provides for a relatively predictable return force in spite of manufacturing tolerances and the like. The spring constant then increases substantially beyond this range of movement. The valve spring 156 is also preloaded to establish a bias of the valve element 144 toward seating against the seat 128 and O-ring 130.

At rest, the relief valve element 144 is seated against the O-ring 130 and relief valve seat 128 because of the preload compression in the valve spring 156. The compression spring 154 may or may not include a preload. However, any preload is smaller than the preload on the valve spring 156 such that the compression force of the valve spring 156 dominates even without air pressure in the valve chamber. The actuator 148 also extends toward the restricted end of the guideway 136 to its travel limit. The actuator 148 also extends midway through the guideway 136. The compression spring 148 separates the valve element 144 from the actuator pin 142, while engaged in the sockets 150 and 152.

As the plate 146 is against the O-ring 130, pressure cannot be vented from the device. As the actuator pin 142 is depressed, this motion is resisted by the pressure within the relief valve cavity 112 exerted against the plate 146 on the side facing the cavity. It is also resisted by the valve spring 156. A typical pump application would employ shop air having a force exerted across the plate 146 of about 100 lbs. A valve spring 156 preferably has a precompression of about 35 lbs. of force.

The force associated with depression of the actuator pin 142 is transmitted to the valve element 144 through the compression spring 154. The compression spring 154 is preferably designed to reach a maximum of about 80 lbs. of force when the socket portions 150 and 152 engage. The 80 lbs. of force remains as no match to the combination of the pressure force of about 100 lbs. and the valve spring force of about 35 lbs. However, once a rigid link is established between the socket portions 150 and 152, force increases substantially instantaneously to in excess of the combined pressure and return spring forces. The cylindrical plate 146 then moves from the O-ring 130 of the valve seat 128.

As pressure drops within the cavity 112, the compression force of the compression spring 154 becomes dominant. The energy stored within the spring can, therefore, drive the valve element 144 further open. As the compression force of the compression spring 154 reduces with expansion of the spring, it comes into equilibrium with the valve spring 156 and remains there until the actuator pin 142 is allowed to return. The bias force of the valve spring 156 then becomes dominant as the force from the compression spring 154 drops toward zero. The valve element 144 can then return to a seated position. The ranges of compression force thus operating provide for the valve spring 156 to have a greater minimum compression force than the compression spring 154 and the compression spring 154 to have a greater maximum force than the valve spring 156.

Two valves control air flow to and from the two air chambers 12 and 14. To this end, the two passageways 62 and 64 lead to two shuttle valves 160 (one shown). The shuttle valves 160 are each positioned within the center section 10 defining a valve housing. The shuttle valves 160 are identical and the outlets therefrom are mirror images on either side of the center section.

Figure 4:
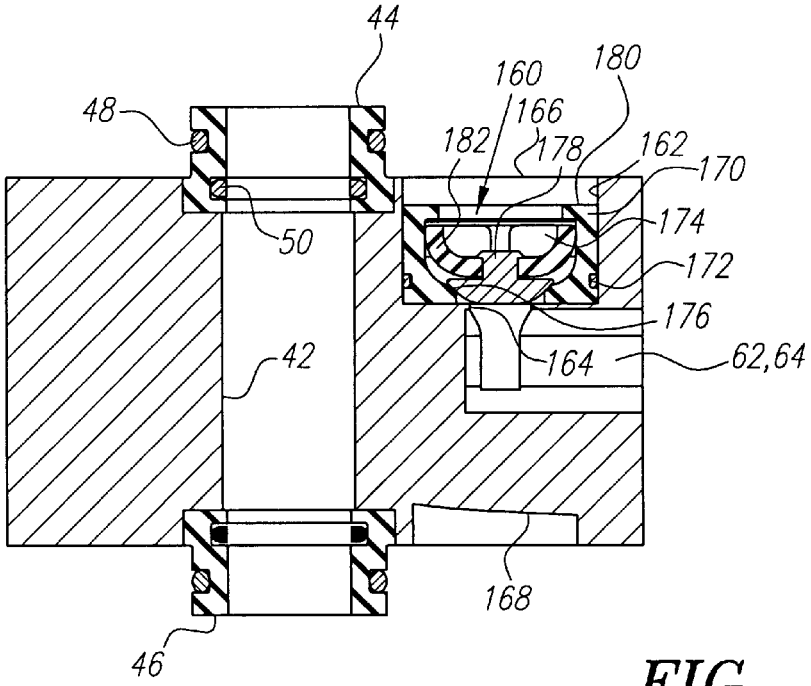
FIG. 4 is a cross-sectional view taken along line 4—4 of FIG. 2.
Figure 5:
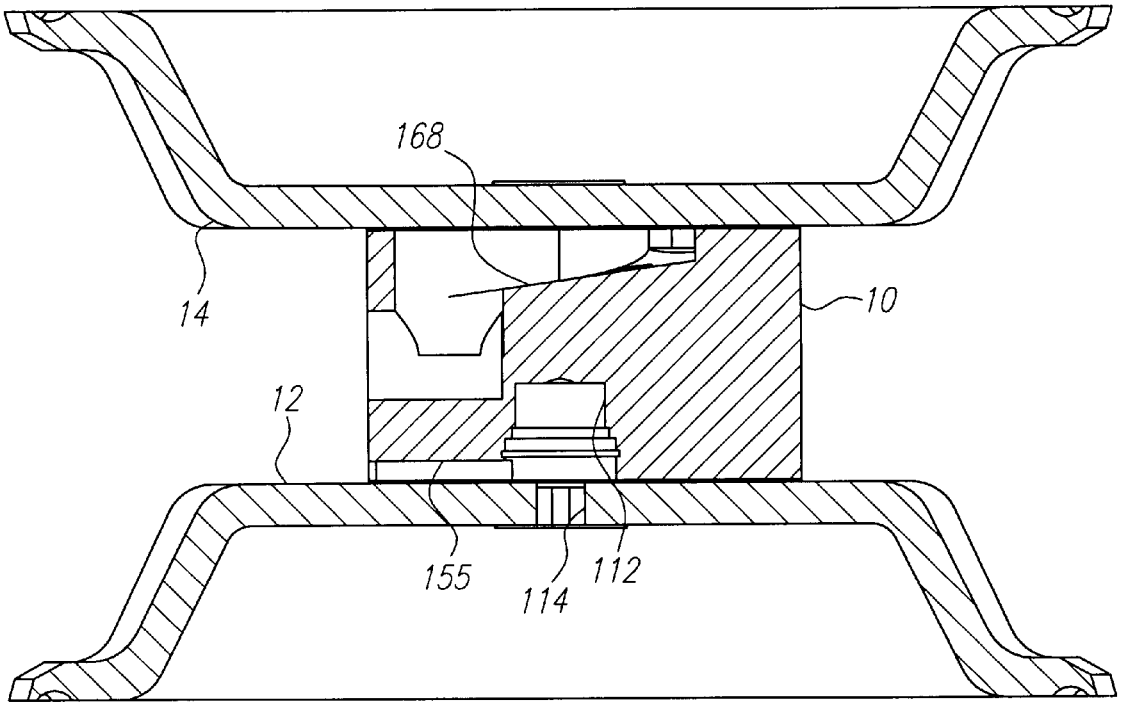
FIG. 5 is a cross-sectional view taken along line 5—5 of FIG. 2 with air chambers in place and without the valve cylinder.

A valve cavity 162 is defined for each shuttle valve 160. Each cavity 162 is open to a side of the center section 10 such that, with a hole through the wall of the air chamber 12, 14, the valve cavity 162 is in open communication with the air chamber 12, 14. The valve cavity 162 is cylindrical and includes a first, inlet port 164 which is at the inner end of the cylinder forming the valve cavity 162. The inlet port 164 is cut such that it is open to the passageways 62 and 64. A second, charging port 166 is simply the end of the cylindrical cavity 162 exiting the center section 10 toward the air chamber 12, 14. A third, exhaust port 168 extends from the wall of the cylindrical valve cavity 162. As can best be seen in FIG. 2, the exhaust port 168 extends with parallel walls to an outlet where conventional muffling may be employed. In FIG. 4, the exhaust port 168 associated with the cavity 162 illustrated cannot be seen. The exhaust port 168 associated with the cavity 162 on the other side of the center section 10 can be seen in the view. From the view in FIG. 2, the walls are seen to be parallel. However, the depth of the exhaust port passage increases from the valve cavity 162 to the outlet at atmosphere as seen in FIG. 5. Typically, the cross-sectional area defined within the exhaust port 168 at the outlet is three times that of the cross-sectional area at the valve cavity 162.

A shuttle valve element 170 is slidably positioned within the valve cavity 162 of each shuttle valve 160 such that it is sealed to form a piston. A ring seal 172 in the sidewall is positioned such that, regardless of the location of the shuttle valve element 170 within the valve cavity 162, the ring seal 172 is between the exhaust port 168 and the inlet port 164. Consequently, flow cannot be directed from the inlet port 164 to the exhaust port 168 without having passed into communication with the air chamber 12, 14.

The shuttle valve element 170 is shown in one of two extreme positions. In the position shown in FIG. 4, the exhaust port 168 is open to the charging port 166 into the air chamber 12, 14. With the shuttle valve element 170 most adjacent the air chamber 12, 14 in the other extreme position, the exhaust port 168 is covered over by the shuttle valve element 170 to prevent exhausting of pressurized air. The end of the shuttle valve element 170 adjacent to the air chamber 12, 14 encounters the air chamber and seals against the smooth surface of the air chamber, which may be of polished metal or smooth polymeric material. The hole (not shown) through the air chamber 12, 14 is smaller than the valve cavity 162 such that a shoulder is provided for this purpose.

The shuttle valve element 170 includes a passageway 174 therethrough. The passageway 174 has a first end adjacent to the inlet port 164 and a second end adjacent to the charging port 166 into the air chamber 12, 14. At the first end, a seat 176 is provided to accommodate a valve element 178. An inwardly extending flange 180 at the second end of the shuttle valve element 170 accommodates and retains one end of a valve spring 182. The valve spring 182 is also formed of resilient material in a cross shape which is then bent to fit within the passageway 174 in the shuttle valve element 170. With the valve element 178 and the spring 182, a one-way valve is formed within the passageway 174. The spring 182 may be compressed in its placement such that a predetermined threshold level of pressure is needed to force the valve element 178 away from the seat 176.

In operation, compressed air, normally shop air, is presented to the inlet passage 56 as a source of pressurized air. The air passes through the inlet port and about the annular groove 78. The control valve piston 76 is to be found at one end or the other of the cylinder 54 and the pressurized air flows through one of the passageways 62 and 64 to one or the other of the shuttle valves 160.

With the control valve piston 76 at the end illustrated in FIG. 2, one of the shuttle valves 160 is subjected to pressure at its first end while the other is not. Consequently, the shuttle valve element 170 of the shuttle valve 160 subjected to pressure at its first end moves to the extreme position within the valve cavity 162 adjacent to the air chamber 12. This closes the outlet port 168.

As pressure builds, the valve element 178 of the one-way valve lifts from the seat 176 to allow flow through the passageway 174 and the charging port 166 into the air chamber 12. This forces one of the pistons 36, 38 toward the associated pump chamber 16, 18. With this movement, the volume of the other air chamber 14 is reduced and pressure builds within the cavity enough such that the shuttle valve element 170, which does not have the incoming pressurized air acting on the valve element 178, will move to the extreme position most distant from the air chamber 14.

To insure that residual air pressure within the nonpressurized passage 64 does not prevent movement of the associated shuttle valve 160, the cavity 82 communicates air through the passage 64 to the associated exhaust passageway 66 in communication with the exhaust port 168 where it is vented to atmosphere.

With the second shuttle valve element 170 displaced from the air chamber 14, the exhaust port 168 is open and provides for the evacuation of the air chamber 14 associated with that shuttle valve 160.

As the shaft 40 completes its stroke, the actuator pin 142 interferes with continuing motion of the pistons 36, 38. As the actuator pin 142 is forced into the center section 10, the valve spring 176 yields along with compression spring 154 as discussed. Ultimately, the relief valve 116 is displaced from the relief valve seat 128 and air from one end of the control valve piston 76 is rapidly exhausted. As this occurs, the control valve piston 76 shifts to the other end of the cylinder 54. At this point, the process is reversed and the shaft 40 moves in the opposite direction.

Accordingly, an improved air driven double diaphragm pump is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A double diaphragm pump comprising two opposed pumping cavities;

two diaphragms, each diaphragm extending across a pumping cavity, respectively, to define an air chamber cavity;

a shaft extending between each of the diaphragms and being slidably mounted relative to the opposed pumping cavities;

a housing between the pumping cavities including two valve cavities, two first ports, two second ports and two third ports through the housing to each of the valve cavities, respectively, the second ports being in communication with the air chamber cavities, respectively, the third ports extending to atmosphere;

two shuttle valve elements each including a sidewall sealably and slidably positioned in the valve cavities, respectively, and a passageway therethrough with a first end, a second end and a valve seat between the first end and the second end, the first port being in communication with the first end and the second port being in communication with the second end, the shuttle valve elements each having two extreme positions, the first with the sidewall covering the third port and the second with the third port uncovered and in communication with the second port;

two one-way valves in the passageways, respectively, biased against the valve seats and permitting flow from the first end to the second end of each passageway, respectively, under preselected pressure;

a source of pressurized air in selective communication with the first ports;

a control valve assembly, the housing further including two relief valve cavities, the control valve assembly including a control valve, control passages from the control valve to the two relief valve cavities, respectively, two pressure relief valves in the relief valve cavities, each with an actuator pin extending to be alternately depressed at preselected limits of the shaft stroke, a relief valve body having a guideway, a relief valve seat and an exhaust, a flow path from the respective control passage through the respective relief valve cavity and across the relief valve seat to the exhaust, an actuator slidably positioned in the guideway with the actuator pin, a relief valve element slidably positioned in the cavity to face the guideway and the relief valve seat and biased toward seating engagement with the valve seat, and a compression spring between the actuator and the valve element.

2. The double diaphragm pump of claim 1, the third port of each of the valve cavities being tapered to increase in cross-sectional area away therefrom.

3. The double diaphragm pump of claim 2, the third port of each of the valve cavities extending to atmosphere and being tapered in one cross-sectional dimension, the cross-sectional area increasing by three times between the valve cavities and atmosphere.

4. The double diaphragm pump of claim 1, the sidewall of each of the shuttle valve elements including a sealing ring between the first port and the third port with the shuttle valve elements in each of the two extreme positions.

5. The double diaphragm pump of claim 1, each of the one-way valves including a valve element and a spring, the valve elements selectively seating on the valve seats, respectively, the springs extending in compression between the shuttle valve elements, respectively, and the valve elements, respectively, with the valve elements being between the valve seats and the springs.

6. The double diaphragm pump of claim 1 further comprising vent passageways from the control valve to atmosphere;

charging passageways from the control valve to the first ports;

an inlet alternately coupling the charging passageways with the vent passageways, respectively, and the inlet passage.

7. The double diaphragm pump of claim 1 further comprising vent passageways from the control valve to atmosphere;

charging passageways from the control valve to the inlet ports;

an inlet alternately coupling the charging passageways with the inlet passage and the vent passageways, respectively.

8. A double diaphragm pump comprising two opposed pumping cavities;

two diaphragms, each diaphragm extending across a pumping cavity, respectively, to define an air chamber cavity;

a shaft extending between each of the diaphragms and being slidably mounted relative to the opposed pumping cavities;

a housing between the pumping cavities, the housing including two valve cavities and two relief valve cavities, the control valve assembly, each valve cavity having an inlet port, a charging port and an exhaust port through the housing, the charging ports being in communication with the air chamber cavities, respectively, the exhaust ports extending to atmosphere;

two shuttle valve elements, each being sealably and slidably positioned in one of the valve cavities, respectively, and each including a passageway therethrough with a first end, a second end and a valve seat between the first end and the second end, the inlet port being in communication with the first end and the charging port being in communication with the second end, the shuttle valve elements each having two extreme positions, the first position being with the shuttle valve element covering the exhaust port and the second position being with the exhaust port uncovered and in communication with the charging port;

two one-way valves in the passageways, respectively, biased against the valve seats and permitting flow from the first end to the second end of each passageway, respectively, with pressure above a preselected amount, each of the one-way valves including a valve element and a spring, the valve elements selectively seating on the valve seats, respectively, the springs extending in compression between the shuttle valve elements, respectively, and the valve elements, respectively, with the valve elements being between the valve seats and the springs;

a source of pressurized air in selective communication with the inlet ports; a control valve assembly including a control valve, control passages from the control valve to the two relief valve cavities, respectively, and two pressure relief valves in the relief valve cavities, each pressure relief valve with an actuator pin extending to be alternately actuated at preselected limits of the shaft stroke, a relief valve body having a guideway, a relief valve seat and an exhaust passage, a flow path from the respective control passage through the respective relief valve cavity and across the relief valve seat to the exhaust passage, an actuator slidably positioned in the guideway with the actuator pin, a relief valve element slidably positioned in the cavity to face the guideway and the relief valve seat and biased toward seating engagement with the valve seat, and a compression spring between the actuator and the valve element.

9. The double diaphragm pump of claim 8, the exhaust port of each of the valve cavities being tapered to increase in cross-sectional area away therefrom.

10. The double diaphragm pump of claim 9, the exhaust port of each of the valve cavities extending to atmosphere and being tapered in one cross-sectional dimension, the cross-sectional area increasing by three times between the cavities and atmosphere.

11. The double diaphragm pump of claim 8, the shuttle valve elements each including a sealing ring thereabout and between the inlet port and the exhaust port with the shuttle valve elements in each of the two extreme positions.

12. A double diaphragm pump comprising a source of fluid pressure having two charging passages alternately receiving pressurized fluid;

two opposed pumping cavities;

two diaphragms, each diaphragm extending across one of the pumping cavities, respectively, to define an air chamber cavity;

two valves, each valve including a valve element, a first port, a second port and a third port, the first ports being in communication with the charging passages, respectively, the second ports being in communication with the air chamber cavities, respectively, the third ports extending to atmosphere, the valve elements controlling communication between the second and third ports;

one-way valves between the charging passages and the air chamber cavities preventing flow toward the charging passages from the air chamber cavities and restricting flow toward the air chamber cavities from the charging passages below a preselected pressure.

13. The double diaphragm pump of claim 12, the one-way valves being spring biased against flow pressure from the charging passages toward closed positions.

14. The double diaphragm pump of claim 13, the one-way valves being through the valve elements, respectively.

15. A double diaphragm pump comprising a source of fluid pressure having two charging passages alternately receiving pressurized fluid;

two opposed pumping cavities;

two diaphragms, each diaphragm extending across one of the pumping cavities, respectively, to define an air chamber cavity;

two valves, each valve including a valve element, a first port, a second port and a third port, the first ports being in communication with the charging passages, respectively, the second ports being in communication with the air chamber cavities, respectively, the third ports extending to atmosphere, the valve elements controlling communication between the second and third ports, the first ports and the second ports being on functionally opposite sides of the valve elements;

one-way valves between the charging passages and the air chamber cavities preventing flow toward the charging passages from the air chamber cavities and restricting flow toward the air chamber cavities from the charging passages below a preselected pressure;

a housing between the pumping cavities having a first surface mating with one of the pumping cavities and a second surface mating with the other of the pumping cavities, the two valves including two valve cavities in the housing, one end of each of the valve cavities being at the pumping cavities, respectively.

16. The double diaphragm pump of claim 15, the two valve cavities being cylindrical, the valve elements having a cylindrical sidewall and the third ports being through the cylindrical sides of the valve cavities.

17. The double diaphragm pump of claim 16, the third ports being in the surfaces of the housing at the pumping cavities.

18. The double diaphragm pump of claim 17, the third ports being tapered to increase in cross section away from the valve cavities toward atmosphere.

19. A double diaphragm pump comprising a source of fluid pressure having two charging passages alternately receiving pressurized fluid;

two opposed pumping cavities;

two diaphragms, each diaphragm extending across one of the pumping cavities, respectively, to define an air chamber cavity;

a housing between the pumping cavities including two cylindrical valve cavities in the housing, a first surface mating with one of the pumping cavities and a second surface mating with the other of the pumping cavities, one end of each of the valve cavities being at the pumping cavities, respectively, each valve cavity including a first port, a second port and a third port, the first ports being in communication with the charging passages, respectively, the second ports being in communication with the air chamber cavities through the ends of the valve cavities at the pumping cavities, respectively, the third ports extending to atmosphere;

valve elements in the valve cavities, respectively, each valve element including a cylindrical sidewall, the third ports being through the housing to the cylindrical sidewalls of the valve cavities, the valve elements controlling communication between the second and third ports, the first ports and the second ports being on functionally opposite ends of the valve elements.

20. The double diaphragm pump of claim 19, the third ports being in the surfaces of the housing at the pumping cavities.

21. A double diaphragm pump comprising a source of fluid pressure including a pressure inlet, a control valve piston and two charging passages, the control valve piston controlling communication between the pressure inlet and the two charging passages to alternately communicate pressurized fluid to the two charging passages;

two opposed pumping cavities;

two diaphragms, each diaphragm extending across one of the pumping cavities, respectively, to define an air chamber cavity;

passageways between the two charging passages and the two air chamber cavities, respectively;

a housing between the pumping cavities including two valve cavities, one end of each of the valve cavities being at the pumping cavities, respectively, each valve cavity including a first port, a second port and a third port, respectively, the first port being in communication with the charging passages, the second ports being in communication with the air chamber cavities, respectively, the third ports extending to atmosphere;

two shuttle valve elements, each shuttle valve element including a sidewall sealably and slidably positioned in the valve cavities, respectively, and a passageway therethrough with a first end, a second end and a valve seat between the first end and the second end, the first port being in communication with the first end and the second port being in communication with the second end, the shuttle valve elements each having two extreme positions, the first with the sidewall covering the third port and the second with the third port uncovered and in communication with the second port;

two one-way valves in the passageways, respectively, biased against the valve seats and permitting flow from the first end to the second end of each passageway, respectively;

at least one valve control passage extending in communication with the control valve piston;

at least one pilot relief valve including a pilot valve element and an actuator pin coupled with and extending from the pilot valve element to be actuated at a preselected limit of diaphragm movement, the pilot relief valve being at the valve control passage to control the valve control passage.

22. The double diaphragm pump of claim 21, the one-way valves between the charging passages and the air chamber cavities preventing flow toward the charging passages from the pumping cavities and restricting flow toward the air chamber cavities from the charging passages below a preselected pressure.

* * * * *